US005105621A

United States Patent [19]

Simmons et al.

[11] Patent Number: 5,105,621

[45] Date of Patent: Apr. 21, 1992

[54] EXHAUST SYSTEM COMBUSTOR

[75] Inventors: Harold C. Simmons, Richmond Heights; Roger V. Jones, Solon, both of Ohio

[73] Assignee: Parker-Hannifin Corporation, Cleveland, Ohio

[21] Appl. No.: 745,814

[22] Filed: Aug. 16, 1991

[51] Int. Cl.[5] ..... F01N 3/38

[52] U.S. Cl. ..... 60/303; 422/183; 431/352

[58] Field of Search ..... 60/303, 39.32; 432/222; 431/352, 353, 350; 422/182, 183

[56] References Cited

U.S. PATENT DOCUMENTS

| | | | |
|---|---|---|---|
| 4,258,544 | 3/1981 | Gebhart et al. | 60/39.32 |
| 4,571,938 | 2/1986 | Sakarai | 60/303 |
| 4,581,891 | 4/1986 | Vsui et al. | 60/286 |
| 4,615,173 | 10/1986 | Usui et al. | 60/286 |
| 5,001,899 | 3/1991 | Santiago et al. | 60/274 |

*Primary Examiner*—Ira S. Lazarus
*Assistant Examiner*—L. Heyman
*Attorney, Agent, or Firm*—Christopher H. Mogan

[57] ABSTRACT

A combustor for an exhaust gas system includes a longitudinally compliant fuel conduit for allowing thermal expansion and contraction of other portions of the combustor relative to the fuel conduit while not misaligning the atomizer to which the fuel conduit is attached. The combustor includes an exhaust duct, a combustion chamber, and an air duct in addition to the atomizer and longitudinally complaint fuel conduit. The combustion chamber and air duct are disposed within the exhaust duct so that they are heated by the exhaust gases passing through the exhaust duct. The fuel conduit is disposed within the air duct so that air passing through the air duct keeps the fuel conduit relatively cool.

7 Claims, 2 Drawing Sheets

EXHAUST SYSTEM COMBUSTOR

BACKGROUND OF THE INVENTION

1. Field of the Invention

This invention relates in general to exhaust system combustors of the type used to regenerate particle traps for catching particulate matter in the exhaust system of a vehicle or the like. More particularly, but without limitation, the present invention relates to such combustors which have a compact design.

2. Description of the Prior Art

Some exhaust systems for vehicles or the like include a particle trap for reducing particulate emissions and other emissions. Traps of this type are especially useful on the exhaust systems connected to diesel engines. Over time such particle traps become saturated or clogged and require regeneration. This regeneration can be achieved by a combustor connected to heat the trapped material to a combustion temperature and thereby clean the trap.

Some combustors for exhaust systems are housed aside from or separate from the exhaust conduit. In other systems the combustor extends entirely within or partially within the exhaust conduit. In order to achieve a compact design it is desirable to have the combustor entirely within the exhaust conduit. In this system a combustion chamber resides in the exhaust conduit and exhaust gases flow around and into the combustion chamber on a path to the particle trap. In such a system it is difficult to arrange the ducts for conveying combustion air to the combustion chamber and the fuel conduit for conveying fuel to the combustion chamber. More particularly, it is a problem to connect the systems in a way which does not degrade the atomization of the fuel in the combustion chamber.

For example, it is particularly a problem to connect the fuel conduit to the combustion chamber which resides within the exhaust conduit because the heat of the exhaust gases passing through the exhaust conduit can overheat the fuel in the exhaust conduit causing undesirable variations in the fuel temperature and pressure. In addition, expansion and contraction of the air duct and fuel connections to the atomization portion of the combustion chamber can cause misalignment of the atomization components of the combustor which degrades the atomization and reduces the efficiency of combustion.

It is accordingly an object of the present invention to provide an improved combustor of a compact design which has a combustion chamber entirely within the exhaust conduit. It is also an object of the present invention to provide such a combustor having a tolerance to thermal gradients and effects created in the combustor by exhaust gases passing through the exhaust conduit.

It is also an object of the present invention to provide an improved combustor for use in an exhaust gas system which has a fuel conduit which is less exposed to heating from the exhaust gases in the exhaust duct while also providing such a fuel conduit which is compliant to prevent misalignment of the atomizer to which the fuel conduit is connected.

SUMMARY OF THE INVENTION

In accordance with these objects the present invention comprises a combustor for use in an exhaust gas system which combustor is tolerant to thermal gradients without degrading the atomization of fuel therein.

The combustor includes an exhaust duct for conveying exhaust gas therethrough. The exhaust duct includes a side wall, an inlet end through which exhaust gas enters the exhaust duct and an outlet end through which exhaust gas exits the exhaust duct. A combustion chamber is provided with an atomization end and a combustion end. The combustion chamber is fixedly mounted in the exhaust duct facing the outlet end of the exhaust duct. An atomizer is mounted in the atomizer end of the combustion chamber for spraying atomized fuel into the combustion chamber.

The present invention also includes an air duct for conveying combustion air to the combustion chamber and extending through the side wall of the exhaust duct to the atomizer end of the combustion chamber. A fuel conduit is fixedly joined to the atomizer for conveying fuel to the atomizer. The fuel conduit has at least a portion thereof extending in the air duct so that the air in the air duct prevents heating of the fuel conduit by the exhaust gases in the exhaust duct. The portion of the fuel conduit which is located in the air duct includes a longitudinal compliance portion. This longitudinal compliance portion allows expansion and contraction of the combustion chamber and the air duct relative to the fuel conduit while maintaining a constant position and alignment of the atomizer with respect to the combustion chamber.

Preferably, the fuel conduit extends within the air duct to a connection outside of the exhaust duct so that no portion of the fuel conduit extends outside of the air duct and within the exhaust duct. In this manner, the fuel conduit is located entirely within the air duct to keep it relatively less heated by the exhaust gases in the exhaust duct.

For a further understanding of the invention and further objects, features and advantages thereof, reference may now be had to the following description taken in conjunction with the accompanying drawings.

DESCRIPTION OF PREFERRED EMBODIMENTS

Figure 1:
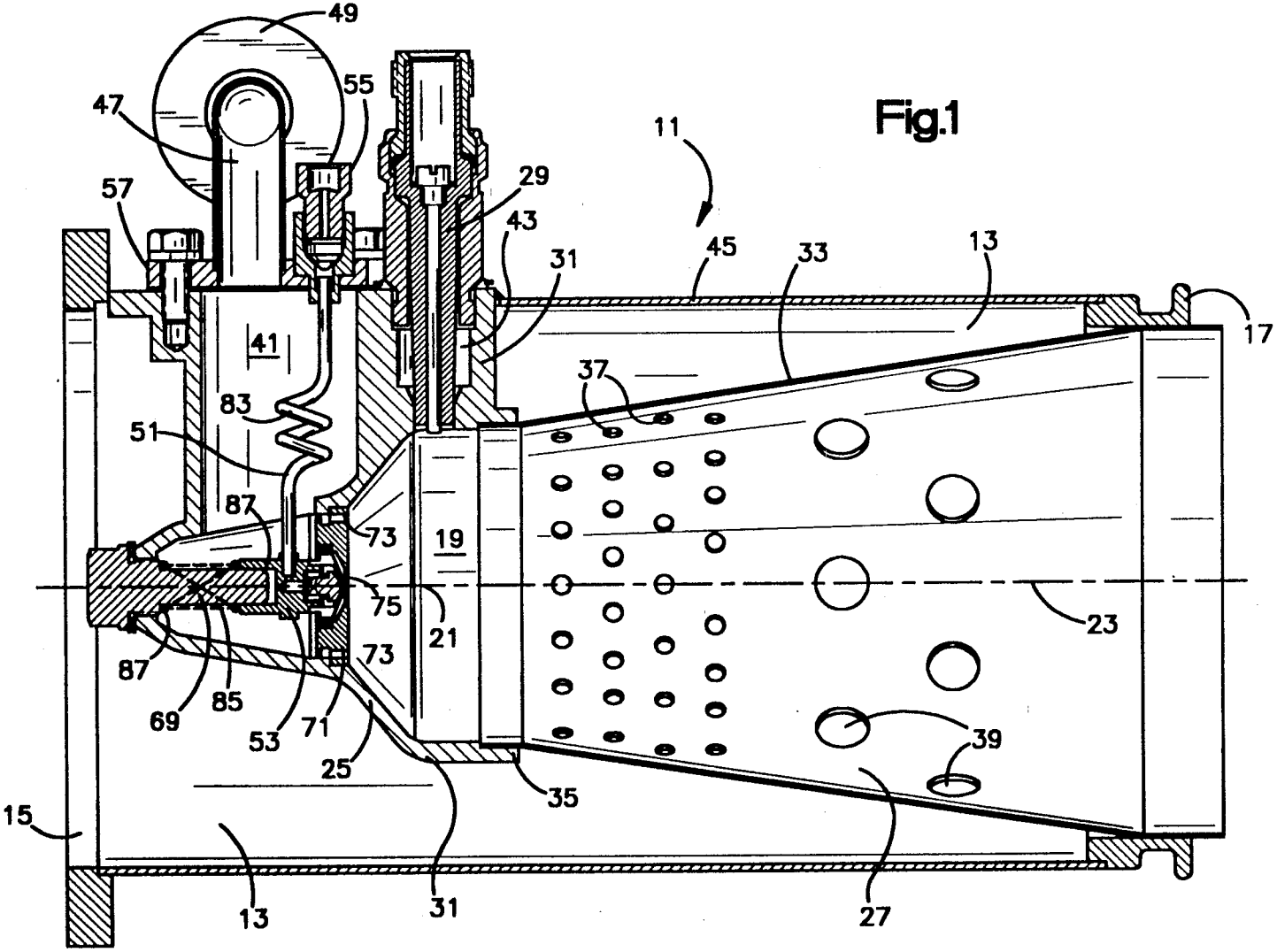
FIG. 1 is a cross sectional view of a combustor constructed in accordance with the present invention.
Figure 2:
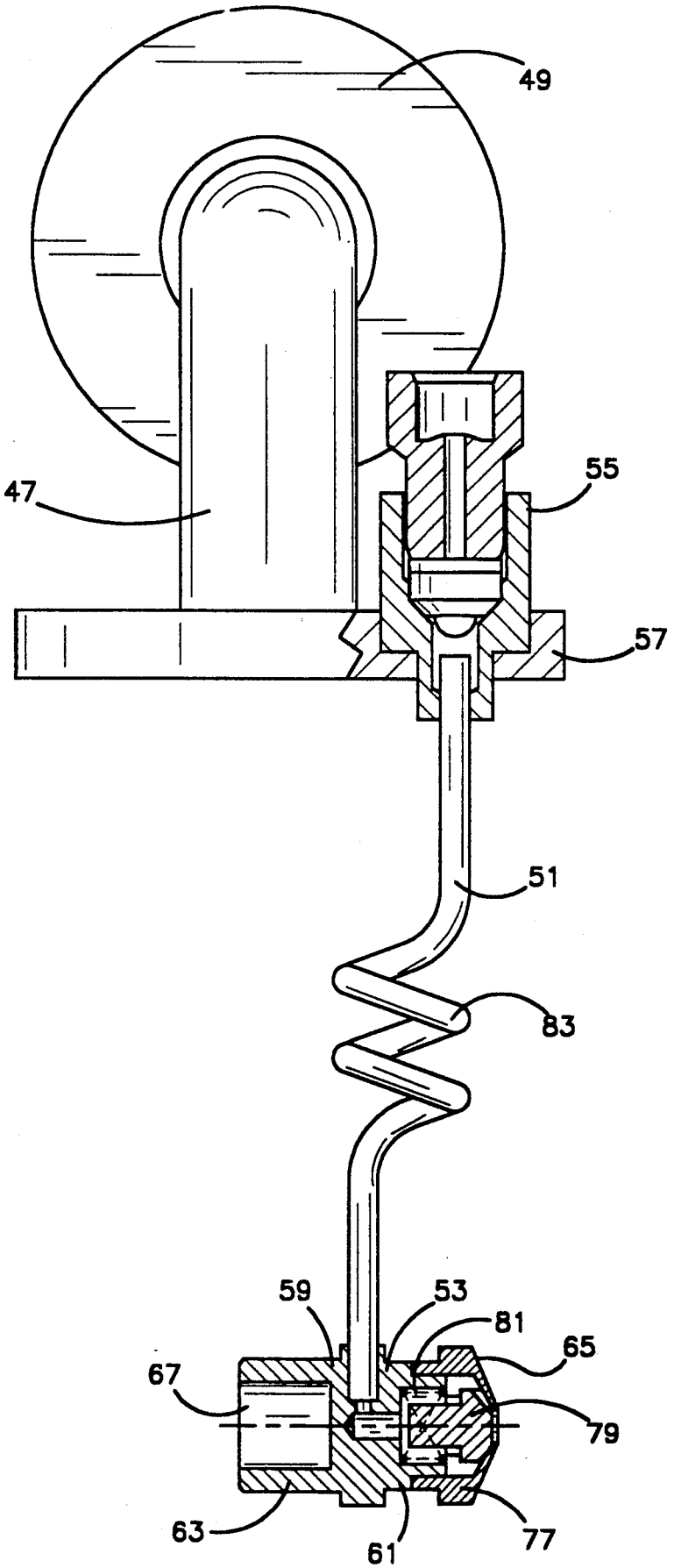
FIG. 2 is a partial cross sectional view of a portion of the combustor shown in FIG. 1.

Referring now to FIG. 1 a combustor constructed in accordance with the present invention is shown at 11. The combustor 11 includes an exhaust duct 13. The exhaust duct 13 is generally cylindrical with an inlet end 15 and an outlet end 17. The inlet end 15 is adapted to be sealingly connected to an exhaust pipe and the outlet end 17 is adapted to be connected to a ceramic particulate trap or the like which, in turn, is connected to a continuing portion of the exhaust pipe. Thus, the exhaust duct 13 is adapted to be connected as a segment in an exhaust pipe which, in turn, is a portion of an exhaust system.

One of the features of the present invention is a compact design allowing the combustor 11 to be inserted as a compact segment of an exhaust pipe.

The combustor 11 is particularly adapted for use in an exhaust system for a diesel engine or the like. Such engines produce particulates which, unless filtered from the exhaust, are emitted into the air. To remove these particulates, a ceramic particulate trap or the like (not shown) can be placed in the exhaust pipe. These particulates are captured by the ceramic particulate trap and are held in the trap until the trap is regenerated by the combustor 11 of the present invention. This regeneration is achieved by means of heating the particulates held in the trap to the combustion temperature of the particulates. Burning of the particulates in the ceramic trap reduces the particulates to gases and ash, unclogging the trap and allowing it to be used for further capturing of particulates.

Located within the exhaust duct 13 is a combustion chamber 19. The combustion chamber 19 is generally conical shaped opening toward the outlet end 17 of the exhaust duct 13. Thus, the combustion chamber faces the outlet end 17 of the exhaust duct. The combustion chamber 19 is located so that the axis 21 of the combustion chamber 19 is aligned along the axis 23 of the exhaust duct 13.

The combustion chamber 19 has an atomizer end 25 and a combustion end 27. The atomizer end 25 of the combustion chamber is formed of a cast housing piece 31 and the combustion end 27 of the combustion chamber 19 is formed of an exhaust liner 33. The exhaust liner 33 is a conically shaped thin metal sheet which extends from the lip 35 of housing 31 to the outlet 17 of exhaust duct 13. Regularly spaced about the exhaust liner 33 are a set of smaller holes 37 and a set of larger holes 39. The smaller holes 37 are located closer to the housing 31 and the larger holes 39 are located closer to the outlet end 17. The holes 37 and 39 are required in order to allow exhaust gases entering the inlet end 15 of the exhaust duct 13 to pass through the exhaust liner 33 and out the outlet end 17 of the exhaust duct 13.

Extending generally at right angles to the combustion chamber axis 21 and the exhaust duct axis 23 are the air duct 41 and the spark plug 29. The air duct 41 is formed in a portion of the housing 31. The air duct 41 extends parallel to and adjacent the opening 43 in housing 31 into which the spark plug 29 is threadedly inserted. The portion of the housing 31 which forms the air duct 41 and opening 43 extends to and through the cylindrical wall 45 of the exhaust duct 13. It forms the support which holds the combustion chamber 19 within the exhaust duct 13.

The air duct 41 is connected to an air pipe 47 outside the exhaust duct 13. Disposed on the air pipe 47 is a check valve 49 which allows air to move through the pipe only toward the combustion chamber 19. An air pump (not shown) is located to supply air to the air pipe 47 upstream of the check valve 49.

Located within air duct 41 is a fuel conduit 51. Fuel conduit 51 is connected at one end to an atomizer assembly 53 and at the other end to a fuel inlet fitting 55. The inlet fitting 55 and the air pipe 47 are both connected to a cover plate 57 which is bolted to housing 31 to cover the air duct 41.

The atomizer assembly 53 to which the fuel conduit 51 is attached includes an atomizer body 59 which has a front end 61 and a rear end 63. Attached to the front end 61 is a fuel swirler assembly 65. The rear end 63 has a cylindrical opening 67 sized to matingly receive a guide pin 69.

Sealingly connected to the housing 31 is an air swirler 71. The air swirler 71 includes both a radially outer swirling air passage 73 and a radially inner or central air passage 75. The fuel swirler assembly 65 fits within the central air passage 75.

The fuel swirler assembly 65 includes an outer piece 77, an inner piece 79 and a spring 81. The outer piece 77 fits closely within the central air passage 75 of air swirler 71 and combines with the air swirler 71 so that the central air passage 75 swirls the air passing therethrough in a vortex which extends out into combustion chamber 19. Similarly, the inner piece 79 and outer piece 77 of the fuel swirler assembly 65 combine to produce a vortex of atomized fuel passing therethrough which extends out into combustion chamber 19. The construction, arrangement and assembly of parts forming the air swirler 71 and the fuel swirler assembly 65 are conventional and well known to those skilled in the art of fuel nozzles.

In order for the proper atomization of fuel to occur in the combustion chamber 19 the fuel swirler assembly 65 must be precicely centrally located in the central air passage 75 of the air swirler 71. This is achieved by making the fuel conduit 51 longitudinally compliant and by aligning the atomizer assembly 53 with the guide pin 69. The outer piece 77 of the fuel swirler assembly 65 fits closely but movably within the air swirler 71. Since the fuel conduit 51 is located within the air duct 41 it is not heated as rapidly as the housing 31 by exhaust gases in the exhaust duct 13. Therefore, the air duct portion of the housing 31 may expand or contract relative to the fuel conduit 51 which, without longitudinal compliance, would cause the fuel duct to become disconnected or cause the atomizer assembly to become misaligned.

Longitudinal compliance is provided in the fuel conduit 51 by a helical bend 83. The fuel conduit 51 can be formed of stainless steel tubing. The stainless steel tubing can be bent into a helical shape 83 and, in this manner, the fuel conduit is longitudinally compliant. By longitudinally compliant it is meant that one end of the conduit is moveable toward or away from the other end of the conduit with a relatively small application of force.

To maintain the atomizer assembly 53 in its forwardmost position in air swirler 71 while maintaining its axial alignment a spring 85 mounted on guide pin 69 is provided. A guide pin 69 is sealingly threaded through housing 31 along the central axis 21. A guide pin spring 85 extends about guide pin 69 to urge the atomizer assembly 53 toward the air swirler 71. The front end 87 of the guide pin 69 has a cylinder shape which mates with the cylindrical opening 67 in the rear end 63 of atomizer body 59. This mating connection allows movement of the atomizer body 59 with respect to the guide pin 69 only longitudinally (along axis 21). The spring 85 bears against a shoulder 87 of the pin and the rear end 63 of the atomizer body 59 to urge the atomizer assembly 53 toward the air swirler 71 along this axis of movement.

In a noncombustion or nonregeneration mode, the combustor 11 of the present invention operates to allow exhaust gases to enter through the inlet end 15, around the housing 31, through the holes 37 and 39 and out the outlet end 17. Exhaust gases are prevented from moving back through air duct 41 by the check valve 49.

In a combustion or regeneration mode, the combustor of the present invention allows exhaust gases to pass through the exhaust duct 13 as in a nonregeneration mode but with combustion occurring in the combustion chamber 19. Combustion air is supplied to the combustion chamber 19 from the air pump (not shown), check valve 49, air pipe 47, air conduit 41 and air swirler 71. This air then enters the combustion chamber through both the radially outer swirling air passage 73 and the central swirling air passage 75. Thus, both an inner and outer vortex of air are provided to the combustion chamber 19. Atomized fuel is supplied to the combustion chamber 19 through a fuel pump (not shown), the fuel inlet fitting 55, the fuel conduit 51 and the atomizer assembly 53. A swirling vortex of atomized fuel combines with the central vortex of swirling air to provide a mixture of fuel and air which can be ignited by the spark plug 29. The combustion of the fuel and air mixture heats the particulate trap downstream of the combustor 11 to regenerate the trap.

Because of the corrosive environment produced by the exhaust gases moving through the exhaust duct 13, it is desirable to construct the components of the present invention of stainless steel. Thus, the wall 45 of exhaust duct 13 can be formed of a sheet of stainless steel and the housing 31 can be formed of cast stainless steel. Similarly, the other components of the present invention can be formed of cast or machined stainless steel. A typical combustor 11 would have a diameter of approximately 5 inches and a length of approximately 10 inches.

Assembly of the present invention can be achieved by conventional means. For example, the air swirler 71 can be brazed to the housing 31, and the housing 31 can be brazed to the wall 45 of exhaust duct 13. The flexibility of the helical bend portion 83 of the fuel conduit 51 assists in inserting and assembling the atomizer assembly 53 in the housing 31 and air swirler 71.

The above discussion of this invention is directed primarily to preferred embodiments and practices thereof. It will be readily apparent to those skilled in the art that further changes and modifications in the actual implementation of the concepts described herein can be made without departing from the spirit and scope of the invention as defined by the following claims.

What is claimed is:

1. A combustor for use in an exhaust gas system which combustor is tolerant to thermal gradients so as not to degrade the atomization of fuel therein, comprising:

an exhaust duct for conveying exhaust gas therethrough having a side wall, an inlet end through which exhaust gas enters said exhaust duct, and an outlet end through which said exhaust gas exits said exhaust duct;

a combustion chamber having an atomizer end and a combustion end fixedly mounted in said exhaust duct facing said outlet end of said exhaust duct;

an atomizer mounted in the atomizer end of said combustion chamber for spraying atomized fuel into said combustion chamber;

an air duct for conveying combustion air to said combustion chamber and extending through said side wall of said exhaust duct to said atomizer end of said combustion chamber; and a fuel conduit fixedly joined to said atomizer for conveying fuel to said atomizer, said fuel conduit having at least a portion thereof extending in said air duct, said portion also including a longitudinal compliance portion for allowing thermal expansion and contraction of said air duct and said combustion chamber relative to said fuel conduit while maintaining a constant position and alignment of said atomizer with respect to said combustion chamber.

2. The combustor of claim 1 wherein said longitudinal compliance portion of said fuel conduit comprises a helical bend in said fuel conduit.

3. The combustor of claim 1 wherein said fuel conduit extends within said air duct so that no portion of said fuel conduit extends outside of said air duct and within said exhaust duct.

4. The combustor of claim 1 wherein said combustion chamber includes:

an air swirler for swirling combustion air conveyed into said combustion chamber, said air swirler being fixed in the atomizer end of said combustion chamber and connected to receive air from said air duct; said atomizer being mounted in said air swirler.

5. The combustor of claim 1 wherein said combustion chamber has a spray axis and said atomizer is mounted in said atomizer end of said combustion chamber so as to be movable, and wherein said atomizer includes a guide piece; and wherein the combustor further includes:

a guide pin connected to said air duct and having a guide portion which extends into said air duct mating with said guide piece of said atomizer for holding said atomizer in alignment with said spray axis; and a spring extending about said guide pin and bearing against said atomizer to urge said atomizer against said atomizer end of said combustion chamber.

6. The combustor of claim 1 wherein said fuel conduit, said air duct and said combustion chamber are formed of stainless steel.

7. The combustor of claim 6 wherein said fuel conduit comprises a cylindrical tube and wherein said longitudinal compliance portion of said fuel conduit comprises a helical bend in said tube.

* * * * *